US011760117B2

(12) United States Patent
Guzzo

(10) Patent No.: US 11,760,117 B2
(45) Date of Patent: Sep. 19, 2023

(54) REVEALABLE SUBSTRATES AND METHODS OF PRODUCING AND USING SAID SUBSTRATES

(71) Applicant: VIRTUAL GRAPHICS, LLC, Easton, PA (US)

(72) Inventor: John V. Guzzo, Easton, PA (US)

(73) Assignee: VIRTUAL GRAPHICS, LLC, Easton, PA (US)

( * ) Notice: Subject to any disclaimer, the term of this patent is extended or adjusted under 35 U.S.C. 154(b) by 253 days.

(21) Appl. No.: 17/025,302

(22) Filed: Sep. 18, 2020

(65) Prior Publication Data

US 2021/0086542 A1 Mar. 25, 2021

Related U.S. Application Data

(60) Provisional application No. 62/902,593, filed on Sep. 19, 2019.

(51) Int. Cl.

| | |
|---|---|
| ***B41M 5/34*** | (2006.01) |
| ***B41M 5/36*** | (2006.01) |
| ***B41M 5/124*** | (2006.01) |

(52) U.S. Cl.

CPC ..... *B41M 5/36* (2013.01); *B41M 5/124* (2013.01); *B41M 5/34* (2013.01)

(58) Field of Classification Search

CPC . B41M 5/36; B41M 5/124; B41M 5/34; B41J 13/00; B41J 15/00; B41J 15/02; B41J 15/044

See application file for complete search history.

(56) References Cited

U.S. PATENT DOCUMENTS

| | | | |
|---|---|---|---|
| 3,953,659 | A | 4/1976 | Truitt |
| 6,411,324 | B1 | 6/2002 | Christiansen |
| 8,054,323 | B2 | 11/2011 | Peters et al. |
| 9,757,968 | B1 | 9/2017 | Guzzo et al. |
| 10,384,484 | B2 | 8/2019 | Guzzo |
| 10,427,440 | B2 | 10/2019 | Guzzo |
| 2005/0001419 | A1 | 1/2005 | Levy et al. |
| 2005/0129446 | A1 | 6/2005 | Johnson |
| 2008/0218539 | A1 | 8/2008 | Hill et al. |
| 2010/0245524 | A1 | 9/2010 | Peters et al. |

(Continued)

FOREIGN PATENT DOCUMENTS

| | | | |
|---|---|---|---|
| GB | 1 043 541 | A | 9/1966 |
| JP | H07-81235 | A | 3/1995 |

(Continued)

OTHER PUBLICATIONS

Technical Data Sheet, "Ropaque OP-62 Opaque Polymer", Dow, Aug. 2015.

(Continued)

*Primary Examiner* — Kristal Feggins
(74) *Attorney, Agent, or Firm* — Norris McLaughlin, P.A.

(57) ABSTRACT

Revealable substrates and methods include an opacifying layer having a plurality of irregular and/or odd-shaped opaque polymer particles defining voids therebetween. At least part of the opacifying layer may be induced to become transparent, for example, by collapsing at least some of the voids to reduce or eliminate internal reflection of light in the opacifying layer. Upon rendering transparent the portion(s) of the opacifying layer, a color material (e.g., ink) disposed underneath the opacifying layer is revealed and/or viewable therethrough.

20 Claims, 2 Drawing Sheets

(56) References Cited

U.S. PATENT DOCUMENTS

| | | | |
|---|---|---|---|
| 2010/0247223 | A1 | 9/2010 | Bibi |
| 2011/0090298 | A1 | 4/2011 | Bombay et al. |
| 2011/0205326 | A1 | 8/2011 | Roth et al. |
| 2013/0302550 | A1 | 11/2013 | Tang et al. |
| 2014/0037901 | A1 | 2/2014 | Chung et al. |
| 2019/0291493 | A1 | 9/2019 | Fisher et al. |

FOREIGN PATENT DOCUMENTS

| | | | |
|---|---|---|---|
| JP | 2002-154273 | A | 5/2002 |
| JP | 2004-034332 | A | 2/2004 |
| JP | 2013-508186 | A | 3/2013 |
| WO | 2007/135403 | A1 | 11/2007 |
| WO | 2008/079357 | A2 | 7/2008 |
| WO | 2011/045180 | A1 | 4/2011 |
| WO | 2015/148619 | A1 | 10/2015 |
| WO | 2017/205749 | A1 | 11/2017 |
| WO | 2017/223198 | A1 | 12/2017 |
| WO | 2018/148027 | A1 | 8/2018 |

OTHER PUBLICATIONS

International Search Report dated Dec. 17, 2020, in connection with PCT International Application No. PCT/US2020/051451.
Written Opinion issued in connection with PCT International Application No. PCT/US2020/051451.

REVEALABLE SUBSTRATES AND METHODS OF PRODUCING AND USING SAID SUBSTRATES

CROSS-REFERENCE TO RELATED APPLICATIONS

This non-provisional application claims priority to U.S. Provisional Patent Application No. 62/902,593 filed on Sep. 19, 2019, which is incorporated herein by reference.

FIELD OF THE DISCLOSURE

The present disclosure relates to the field of printing and printable substrates and improves upon the printing substrates and methods described in U.S. Pat. No. 8,054,323 (hereinafter "the '323 patent"). More particularly, the present disclosure is directed to new printing substrates, methods of producing and/or using said substrates, and an opaque layer of said substrates that is provided by a plurality of irregular or odd-shaped polymer particles defining voids therebetween. The opacifying layer of said substrates may be induced to become transparent and reveal color material (e.g., ink) thereunder. For example, a thermal print head can transfer thermal energy to portions of the substrate to render the opacifying layer transparent at those portions, and thereby reveal a color underlying the opacifying layer at those portions.

SUMMARY OF THE DISCLOSURE

The present disclosure is directed to revealable substrates and methods of producing and/or using the said substrates. Additionally, the present disclosure is directed to revealable substrates that have an opaque or opacifying layer that may be induced to become transparent to reveal a color below the opacifying material. The opaque layer may be induced by heat, pressure, light energy, and/or chemical reaction to become transparent and thereby reveal color material (e.g., ink) thereunder. The opacifying layer may be sensitive to light, thermal energy or heat, a chemical, and/or pressure to define a light, thermally-, a chemically-, and/or a pressure-sensitive substrate. The opaque layer may be induced to become transparent by being exposed to a light frequency and/or energy (hereinafter "light energy"), heated at high temperature or to an elevated temperature (i.e., a temperature higher than an ambient temperature or other threshold), subjected to an increased pressure (i.e., in excess of atmospheric pressure), chemically reacted, or changed, and/or other transparency induction methods. As a result of the application of sufficient light energy, heating, pressure application, and/or chemical change, the opaque layer of substrate of the revealable substrates becomes transparent. More particularly, the opacifying layer comprises a plurality of irregular or odd-shaped polymer particles defining voids therebetween and, to transition from an opaque state to a transparent state, the structure of the opacifying layer is at least partially collapses to reduce or eliminate the voids, thereby causing the opacifying layer to transmit incident light instead of internally reflecting incident light.

In some configurations, a first side surface of the revealable substrates has a color material, such as ink, substantially bordering and/or covering the entire first side surface or at least a portion of the first side surface. The color material (e.g., ink) may be of any color or colors as desired. Further, the revealable substrates may have an opacifying material and/or layer (hereinafter "opacifying layer") that covers the color material (e.g., ink) on the first side surface of the revealable substrates. As a result, the opacifying layer, when viewed prior to any induced transparency, obscures, blocks, and/or covers the color material (e.g., ink) on the first side surface. The opacifying layer provides a second side surface of the revealable substrates that only shows or appears as an opaque color, which may be white for example. It is only upon heating and/or applying pressure (or other stimulus) that the color material (e.g., ink) on the first side surface is revealed and/or viewable. The opacifying layer of the present disclosure comprises a plurality of irregular and/or odd-shaped polymer particles that may also have different shapes and/or sizes. In some embodiments, the opacifying layer comprises one or more non-spherical polymer particles that may or may not have an opaque color. In some such embodiments, the one or more non-spherical polymer particles may have the opaque color that may be induced to become transparent. In other embodiments, the one or more non-spherical polymer particles may be or comprise one or more rod-shaped particles, one or more flake-shaped particles, or combinations of rod-shaped particles and flake-shaped particles.

In one or more embodiments, the irregular and/or odd-shaped polymer particles are sensitive to application of light energy, heat, pressure and/or chemical change such that exposure to the light frequency, heated to a predetermined temperature, subjected to a predetermined pressure, and/or chemically changed, the opacifying layer becomes transparent and/or clear. As a result of becoming transparent and/or clear, the opacifying layer transmits incident light to reveal the color material (e.g., ink) disposed on the first side surface of the revealable substrates or underneath the opacifying layer and/or the plurality of irregular and/or odd-shaped polymer particles.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Figure 2:
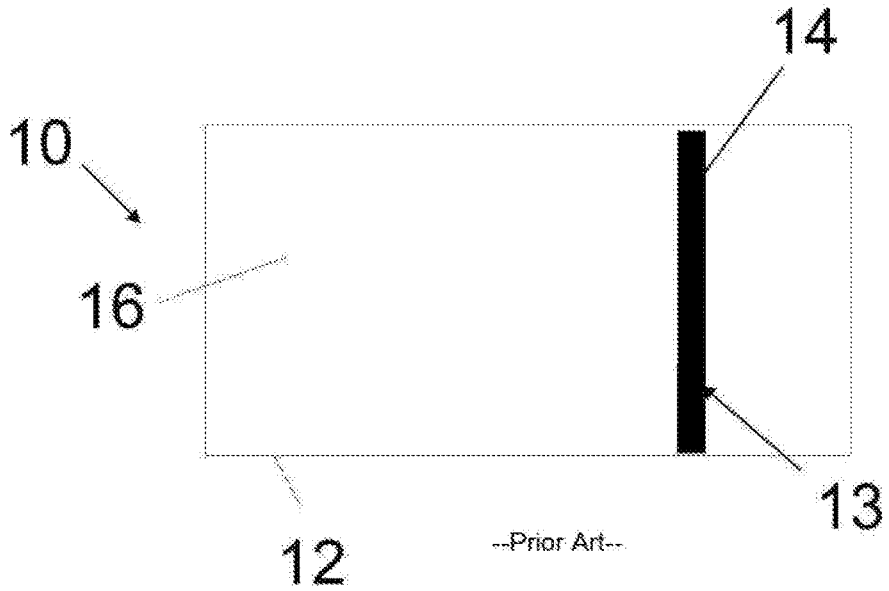
FIG. 2 is a top view of a thermally sensitive substrate formed after being subjected to a thermal print process in accordance with the teachings of the '323 patent.

Referring now to the drawings, a thermal-, light energy-, chemical-, and/or pressure-reveal substrate of the present disclosure is generally referred to by the numeral 10. One embodiment of the present disclosure is directed to a thermal, a light energy, a chemical, and/or a pressure reveal substrate 10 (hereinafter "substrate 10") which includes a light energy, thermally, pressure and/or chemically sensitive substrate or strata 12 (hereinafter "sensitive substrate 12") having an opacifying material or layer 11 which may be induced to become transparent (i.e., transition from an opaque state to a transparent state). For example, the opacifying material 11 may be induced to become transparent by being exposed to light energy, heated at high temperature, subjected to pressure, and/or chemically reacted or changed. As a result, the opacifying material 11 becomes transparent and/or clear to reveal color material 14 as depicted in region 13 of FIG. 2.

The opacifying material 11 comprises a plurality of irregular and/or odd-shaped polymer particles (hereinafter "polymer particles"). An opacity of the opacifying material 11 may depend upon spacings and/or voids between the polymer particles. The polymer particles may be non-spherical and/or may have different shapes and/or different sizes. The opacifying material 11 may be induced to become transparent by being exposed to light energy, heated at high temperature, subjected to pressure, and/or chemically reacted or changed. As a result, the polymer particles may melt and/or change shapes such that the spacing and/or voids between the polymer particles are removed or lost and the opacifying material becomes transparent and/or clear to reveal the color material 14.

In some embodiments, the polymer particles of the opacifying material 11 provide dual purposes for both thermal imaging and inkjet printing processes and/or methods. More specifically, the polymer particles provide an improved thermal imaging quality or sharpness and an improved inkjet receptiveness. Moreover, the improved thermal imaging quality provided by the polymer particles is advantageous over traditional thermal printing mechanisms. The polymer particles of the opacifying material 11 are advantageous because no leuco dyes, no sensitizer, and/or no color developers are required or necessary which makes the opacifying material 11 of the present disclosure compliant and/or in accordance with increased health and/or environmental laws and regulations. For example, embodiments of the opacifying material 11 may be completely free of, or at least substantially free of, leuco dyes, sensitizers, and/or color developers.

In some embodiments, the polymer particles comprise at least one first portion of polymer particles and at least one second portion of polymer particles that each have different sizes and/or different shapes. The at least one first portion of polymer particles may have first sizes and/or first shapes, and the at least one second portion of polymer particles may have second sizes and/or second shapes. In some configurations, the first sizes are similar to the second sizes and the first shapes are different than the second shapes; the first sizes are different than the second sizes and the first shapes are similar to the second shapes, or the first sizes are different than the second sizes and the first shapes are different than the second shapes. The spacings and/or voids between the polymer particles of the at least one first portion may be the same as, different than, or substantially similar to the spacing and/or voids between the polymer particles of the at least one second portion. In some embodiments, a ratio of the respective surface areas and/or masses of the first portion(s) to the second portion(s) may be about 1:1, greater than about 1:1, or less than about 1:1. For example, the ratio of the respective surfaces areas or masses of the first portion(s) to the second portion(s) may be from about 1:1 to about 10:1; from about 3:1 to about 8:1, or from about 4:1 to about 6:1.

Figure 3:
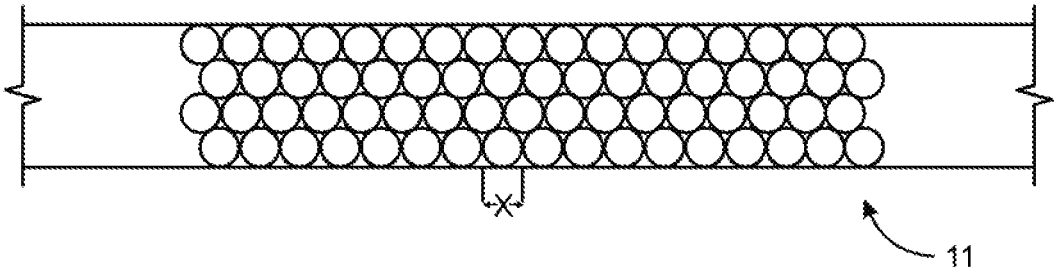
FIG. 3 (Prior Art)
FIG. 3 is a side plan view of a first packing arrangement of known spherical emulsion particles.
Figure 4:
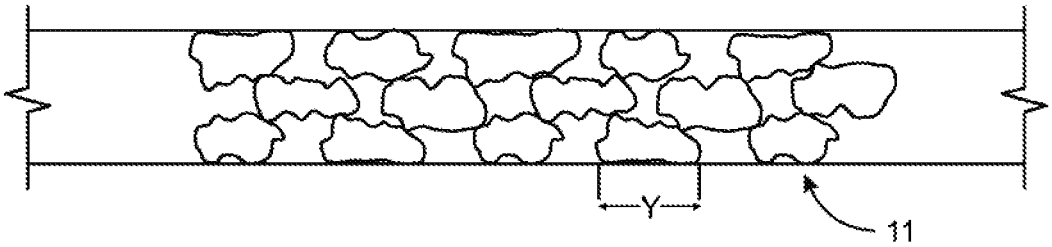
FIG. 4 is a side plan view of a second packing arrangement of the present irregular and/or odd-shaped polymer particles according to one or more examples of the disclosure.

As shown in FIG. 3, known spherical emulsion particles achieve a first packing arrangement having a greater hexagonal packing, a greater ordered arrangement, and first average particle sizes X. In contrast, the second packing arrangement of the present polymer particles has no or less hexagonal packing than the first packing arrangement, no or less ordered packing than the first packing arrangement, and second average particle sizes Y as shown in FIG. 4. The second average particle sizes Y of the present polymer particles may be less than, greater than, or about equal to the first average particle sizes X of the known spherical emulsion particles. In some embodiments, the second average particle sizes Y of the present polymer particles may comprise average particle sizes of at least about 50 nm, at least about 100 nm, at least about 150 nm, at least about 250 nm, no more than about 1,000 nm, no more than about 500 nm, no more than about 450 nm, no more than about 400 nm, or no more than about 350 nm. In other embodiments, the second average particle sizes Y of the present polymer particles may have average particle sizes of up to about 1,000 nm or up to about 1,500 nm. In one or more embodiments, the second average particle sizes Y of the present polymer particles may have average particle sizes between and/or including about 1,000 nm and about 1,500 nm.

In embodiments, the polymer particles may provide high or improved opacity, good or improved resolubility, and/or good or improved water and rub resistance to the substrate 10 (e.g., relative to spherical particles). The spacings and/or voids between the polymer particles may receive ink, printing color(s), and/or printed indicia for inkjet color printing of the substrate 10. At least parts of the layer of opacifying material may be rendered transparent to reveal color material (e.g., ink) underneath the polymer particles, e.g., for direct thermal printing of the substrate 10. In some embodiments, one or more of the polymer particles may be aligned such that, when in the transparent state or condition, the transparency clearly reveals the color material underneath the opacifying material 11. As a result, thermal imaging of the substrate 10 may achieve improved image density and/or improved sharpness for thermal printing of the substrate 10.

In some embodiments, the sensitive substrate 12 may include one or more opacifiers such as titanium dioxide in a particulate form as an opacifier and/or white pigment. Particulate titanium dioxide for use as an opacifier in a polymer composition and products formed therefrom is widely available and may include titanium oxide, calcium carbonate, zinc white, white lead, lithopone, alumina white, white carbon, zirconium oxide, tin oxide, barium sulfate, barium carbonate, or a combination thereof.

The polymer particles of the opacifying material 11 may have a heat melting and/or transition property or a suitable glass transition state (hereinafter "Tg") which defines a pseudo second order phase transition in which a supercooled melt yields, on cooling, a glassy structure and properties similar to those of crystalline materials, e.g., of an isotropic solid material. The Tg may be applicable to wholly or partially amorphous solids such as common glasses and plastics (i.e., the polymer particles). The heat melting temperature and/or Tg of the polymer particles of the opacifying material may be less than about 120° C., less than about 110° C., less than about 105° C., less than about 95° C., and less than about 85° C. In some embodiments, the heat melting temperature and/or Tg of the polymer particles may be in the range from about 80° C. to about 130° C., 90° C. to about 120° C., from about 100° C. to about 110° C., or from about 100° C. to about 105° C. In other embodiments, the heat melting temperature and/or Tg of the polymer particles may be greater than about 70° C., greater than about 80° C., greater than about 95° C., or greater than about 100° C.

In embodiments, the polymer particles of the opacifying material 11 may comprise at least one of styrene and acrylate and/or may be provided in a suspension and/or with a carrier. The suspension may be in the form of a water-based emulsion. In embodiments, the water-based emulsion may be an acrylic emulsion or a styrene acrylic emulsion. The water-based emulsion may be a non-film forming emulsion or a film-forming emulsion. The water-based emulsion may have a pH at 25° C. of less than about 8.5, less than about 8.0, less than about 7.5, greater than about 6.5, greater than about 7.0, or about 7.5. The water-based emulsion may have a viscosity at 25° C. of less than about 100 cps, at least about 200 cps, at least about 300 cps, at least about 400 cps, no more than about 2200 cps, no more than about 2100 cps, or no more than about 2000 cps. The water-based emulsion may have a molecular weight (hereinafter "Mw") of greater than about 150,000, greater than about 175,000, greater than about 200,000, less than about 250,000, less than about 230,000, or less than about 210,000. The water-based emulsion may have a density at 25° C. of less than about 1.12 $g/cm^3$, less than about 1.10 $g/cm^3$, less than about 1.06 $g/cm^3$, greater than about 1.02 $g/cm^3$, greater than about 1.04 $g/cm^3$, or greater than about 1.06 $g/cm^3$.

In addition to the polymer particles, the opacifying material 11 may further comprises at least one wax, at least one optional sensitizer, at least one optical brightener, at least one binder or resin, and/or at least one optional additive. In embodiments, the optional additive may comprise one or more components selected from the group of components consisting of: clays, defoamers, surfactants, biocides, viscosity modifiers, and/or rheology modifiers. In other embodiments, the optional additive may comprise at least one component selected from the group of components consisting of: emulsifiers, surfactants, lubricants, coalescing agents, plasticizers, antifreezes, curing agents, buffers, neutralizers, thickeners, rheology modifiers, humectants, wetting agents, biocides, plasticizers, antifoaming agents, UV absorbers, fluorescent brighteners, light or heat stabilizers, biocides, chelating agents, dispersants, colorants, water-repellants, anti-oxidants, and one or more combinations thereof.

In embodiments, the polymer particles may be present in the opacifying material 11 at a concentration of at least about 5% by weight, at least about 10% by weight, at least about 20% by weight, at least about 25% by weight, at least about 40% by weight, at least about 50% by weight, or greater than about 50% by weight. In other embodiments, polymer particles may be present in the opacifying material at a concentration of less than about 55% by weight, less than about 45% by weight, less than about 30% by weight, less than about 20% by weight, less than about 15% by weight, or less than about 8% by weight. All concentrations by weight are calculated relative to a total weight of the opacifying material 11.

The at least one wax may be provided in a suspension and/or with at least one carrier. In embodiments, the at least one wax may be at least one selected from a paraffin wax, a microcrystalline wax, a carnauba wax, a methylol stearoamide, a polyethylene wax, a polystyrene wax, a fatty acid amide-based wax, or a combination thereof. In other embodiments, the one wax may comprise at least one selected from erucamide, stearic acid amide, palmitic acid amide, ethylene-bis-stearic acid amide, or a combination thereof.

The at least one optional sensitizer may be configured to lower a melting and/or Tg temperature of polymer particles. For example, the at least one optional sensitizer may be selected from 2-benzyloxynaphthalene, dimethylbenzyl oxalate, m-terphenyl, ethylene glycol tolyl ether, p-benzyl biphenyl, 1,2-diphenoxy methyl benzene, 1,2-diphenoxyethane, diphenylsulfone, aliphatic monoamide, aliphatic bisamide, stearyl urea, di(2-methylphenoxy)ethane, di(2-methoxyphenoxy)ethane, .beta.-naphthol-(p-methylbenzyl) ether, .alpha.-naphthyl benzyl ether, 1,4-butanediol-p-methyl phenyl ether, 1,4-butanediol-p-isopropyl phenyl ether, 1,4-butanediol-p-tert-octyl phenyl ether, 1-phenoxy-2-(4-ethylphenoxy)ethane, 1-phenoxy-2-(chlorophenoxy) ethane, 1,4-butanediol phenyl ether, diethylene glycol bis (4-methoxyphenyl)ether, and 1,4-bis(phenoxymethyl) benzene. These optional sensitizers may be used alone or in a combination of two or more thereof. In embodiments, the opacifying material 11 may be formulated, adapted, and/or configured such that inclusion of the optional sensitizer is reduced or eliminated. For example, some embodiments of the opacifying material 11 may be completely free, or at least substantially free, of the optional sensitizer.

The at least one optical brightener may comprise one or more optical brightening agents, one or more fluorescent brightening agents, one or more fluorescent whitening agents, or a combination thereof. In embodiment, the at least one optical brightener may absorb light in the ultraviolet and violet region of the electromagnetic spectrum and/or may re-emit light in the blue region by fluorescence. For example, the at least one optical brightener may comprise one or more stilbenes.

The at least one binder or resin may comprise one or more thermoplastic and/or crosslinkable resins. In embodiments, the at least one binder or resin may be one or more selected from polyvinyl alcohol, protein, such as, for example, casein, starch, gelatin, copolymers of acrylic acid esters or methacrylic acid esters, copolymers of styrene and acrylic or methacrylic acid esters, copolymers of styrene and acrylic acid, styrene-butadiene copolymers, copolymers of vinyl acetate with other acrylic or methacrylic acid esters, and one or more combinations thereof.

In embodiments, the opacifying material 11 comprising the polymer particles disclosed herein may be disposed on and/or utilized with the substrate 10 and/or in the present method also disclosed herein. In other embodiments, the opacifying material 11 comprising the polymer particles disclosed herein may be utilized with the systems and methods set forth in U.S. Patent Application Publication No. 2019/0111719 and U.S. Pat. Nos. 9,757,968 and 10,384,484, which are all directed to color matrix substrates covered with opacifying hollow microspheres for revealing one or more colors covered by the hollow microspheres.

Figure 1:
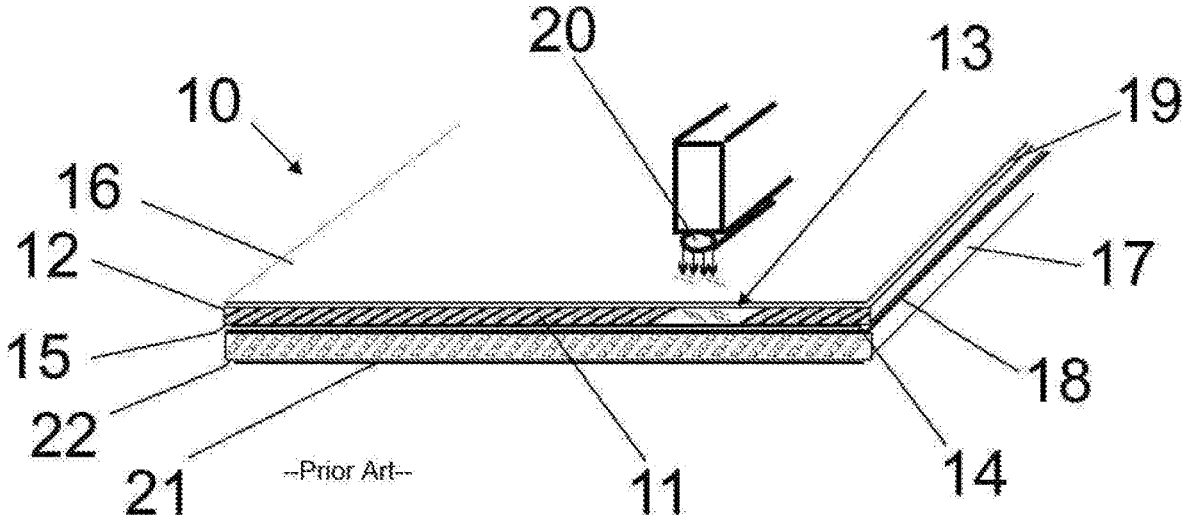
FIG. 1 is a perspective view of a revealable substrate in accordance with the teachings of the '323 patent.

As shown in FIG. 1, a first side surface 15 of the substrate 12 may include or be coated with color material 14, such as ink, covering at least a portion, or substantially the entire, of the first side surface 15. The color material 14 may be of any desired color or colors. By virtue of the sensitive substrate 12 having the opacifying material 11, when viewed from a second side surface 16 prior to any thermal pressure application, such as by a thermal print head 20, the color material 14 is not viewable. The opacifying material 11 may be part of a physical composition of the sensitive substrate 12 or may be a separate and/or independent layer or layers. In embodiments, this may be accomplished by providing the polymer particles disclosed herein which may appear white or opaque until application of at least one of heat, pressure, or a combination thereof. Thus, second side surface 16 may only show opaque color, which may be white, for example. It is only upon application of high temperature heat and/or pressure that the color material 14, such as black or one or more other colors, on the first side surface 15 is revealed or viewable.

The opacifying material 11 comprising the polymer particles which appears to eye of viewer as white or opaque when applied over a surface, and regardless of whether applied to a color or a clear surface, renders the viewed surface white. Upon applying a predetermined pressure or applying a predetermined heat via a print head 20, the polymer particles are rendered non-opaque and the region 13 to which such print head 20 is applied enables transparency thus revealing the color material 14 thereunder.

In embodiments, an adhesive material 18, such as pressure sensitive adhesive, may be applied to a side surface opposite with respect to the first side surface 15 having the ink 14 thereon, for example, to permit the sensitive substrate 12 to be adhered to another surface, such as a product package. A release substrate 17 may be applied to the adhesive 18. Optionally in lieu of release substrate 17, a paper-based substrate 17 may be applied to the adhesive 18 thereby forming a composite thermal and/or pressure sensitive reveal substrate for the substrate 10. The paper-based substrate 17 may be mated to the sensitive substrate 12 with the color material 14 contained therebetween or as part thereof. PSA or other adhesive material may be employed to perform connection between the release substrate or paper substrate backing 17 and the sensitive substrate 12. The substrate backing 17 may include a color paper, film, or board, for example.

The sensitive substrate 12 may also comprise the polymer particles disclosed herein to render a further white appearance by virtue of light scattering properties in the polymer particles and/or provided by the opacifying material 11. The sensitive substrate 12 may have a heat melting or Tg in the range from about 80° C. to about 120° C. for one or more printing methods and/or applications disclosed herein. For example, in certain embodiments, the polymer particles have a melting temperature or glass transition temperature of from about 80° C. to 120° C., from 90° C. to 110° C., or from 95° C. to 105° C.

Additionally, the sensitive substrate 12 may include another coating 19 such as varnish as a protective element (a so-called over print lacquer) to protect the opacifying material 11. The coating 19 may be of a polymer material such as a modified styrene acrylic polymer which may be essentially transparent or clear and have a higher melt point than polymer particles of the opacifying material 11 to serve as a protective barrier for the underlying opacifying material 11 against normal user handling and exposure to elements of sun and heat, but permit melting and/or pressurizing of the polymer particles of the opacifying material 11 to effect printing as explained herein.

The thermal and/or pressure print head 20 may be utilized to perform melting or pressure to transition the polymer particles of the opacifying material 11 from opaque to translucent and may do so in selected portions of the sensitive substrate 12. The thermal and/or pressure print head 20 may be equipped to provide a sufficient temperature or pressure to effect melting or pressure transition of the sensitive substrate 12. Some applications may find it more suitable to provide the sensitive substrate 12 with a lower transition state by employing low crosslinking technology. By selecting the proper polymer particles, the melting point may be less than about 110° C., less than about 105° C., less than about 100° C., less than about 90° C., or less than about 80° C. The grade of polymer particles may have chemical resistance which does not melt at room temperature.

In embodiments, the sensitive substrate 12 may comprise a material appearing white and having an appropriate melting point for safe application use with a thermal print head 20. Thus, the substrate 10, when viewed from the first side surface 15, may appears white or of light color which precludes viewing the color material 14. Upon heating to affect a transition state of the polymer particles of the opacifying material 11, the glass-like appearance is achieved and the opacifying material is tailored in an amount to reveal the color material 14 in a usable manner.

Unlike other prior art thermal activated paper, the present polymer particles may be less sensitive to subsequent exposure of UV rays, luminescent lamps, perspiration of hands and fingers and slight rubbing or other solvents. By way of contrast the substrate 10 disclosed herein is an excellent substrate that may solve one or more of the above-mentioned various difficulties. The color revealed image may be any of one or more various colors, such as, for example, black, red, dark purple, blue, and/or the like. While it is conceived that traditional color-developing reaction materials can be employed in the present disclosure, the substrate 10 disclosed herein provides a more secure, simpler, and less expensive product. In some embodiments, the product provided, produced, and/or manufactured by or from the substrate 10 may be a direct thermal imaging product and/or a pressure sensitive product. For example, the substrate 10 may be a pressure sensitive label, tag, ticket, a point-of-sale document, or receipt, or one or more combinations thereof. In other embodiments, the substrate 10 may be or comprise one or more thin layers, one or more films, or a combination thereof.

In addition to the product formed being more stable in typical ambient temperatures, the substrate 10 disclosed herein may also provide for a quick and easy means for destroying sensitive information printed thereon, such as in the case of HIPAA labels. In this regard, the labels can simply be passed through a heated platen or pressure roller nips and the sensitive information will be rendered unreadable. In the case of forming labels, an adhesive material 18 may be applied either directly over the colored material 14 and surface side 15 or adhesive 21 may be applied to a back side 22 of paper substrate backing 17.

The substrate 10 disclosed herein may exhibit and/or have easy handling properties and a good appearance and touch. According to further features of the substrate 10, the sensitive substrate 12 suppresses aging and provides high stability for a long period as well as for enhancing contrast of thermally revealed images to solve the difficulty in reading such images.

Therefore, even when a highly transparent substrate such as a completely transparent film of polyethylene is used, the product after coating has a white appearance to distinctly contrast the heat revealed image. An amount of the opacifying material 11 should be such as to permit translucent effect to be achieved upon heating or pressure yet mask the colored material 14 prior thereto with the thermal and/or pressure print head 20. Thus, the substrate 10 disclosed herein has succeeded in improving conventional thermal sheet material which is subject to spontaneous color-development (discoloration) in background from one or more of the reasons previously mentioned. The substrate 10 may also provide for a superior color contrast by the sensitive substrate 12 with the opacifying material 11 and renders a distinct image through the region 13.

An example to illustrate, but not to limit the invention, includes about 25% by weight of the polymer particles in the opacifying material 11 coating over a color paper substrate. A protective overprint varnish with higher heat resistance styrene-acrylic having melting point range exceeding that of the polymer particles of the opacifying material 11 and which permits heat to radiate through it yet not melt to the print head 20 may be employed.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A thermal and/or pressure reveal substrate comprising:
a layer of opacifying material;
color material disposed on a first side of the layer of opacifying material;
wherein the layer of opacifying material covers the color material,
wherein the opacifying material, in an opaque state, comprises a plurality of irregular and/or odd-shaped opaque polymer particles defining voids therebetween and having different shapes and/or different sizes, and
further wherein the opacifying material is configured to, upon application of sufficient temperature and/or pressure, change from the opaque state to a transparent state to reveal the color material underneath the opacifying material.

2. The reveal substrate of claim 1, further comprising:
a substrate backing to which the color material is coupled;
wherein the color material is disposed between the substrate backing and the layer of opacifying material.

3. The reveal substrate of claim 1, wherein the plurality of irregular and/or odd-shaped opaque polymer particles have melting temperature and/or a glass transition temperature of equal to or less than about 105° C.

4. The reveal substrate of claim 1, wherein the plurality of irregular and/or odd-shaped opaque polymer particles comprise at least one polymer selected from the group of polymers consisting of: styrene and acrylate.

5. The reveal substrate of claim 4, wherein the water-based emulsion is a styrene acrylic emulsion.

6. The reveal substrate of claim 1, wherein the plurality of irregular and/or odd-shaped opaque polymer particles are provided in the form of a water-based emulsion.

7. The reveal substrate of claim 1, wherein the opacifying material further comprises at least one component selected from the group of components consisting of:
wax;
sensitizer;
optical brightener;
binder or resin; and
additive.

8. The reveal substrate of claim 1, wherein the plurality of irregular and/or odd-shaped opaque polymer particles have an average particle size of up to about 1,500 nm.

9. The reveal substrate of claim 8, wherein the average particle size is no more than about 1,000 nm.

10. The reveal substrate of claim 1, wherein the plurality of irregular and/or odd-shaped opaque polymer particles have average particle sizes between, and including, about 1,000 nm and about 1,500 nm.

11. The reveal substrate of claim 1, wherein the voids are disposed between the irregular and/or odd-shaped opaque polymer particles.

12. A method comprising:
providing a color material covered with a layer of opacifying material in an opaque state such that the opacifying material impedes visibility of the color material through the opacifying material; and
changing at least a portion of the layer of opacifying material from an opaque state to a transparent state to reveal the color material underneath the opacifying material, and
wherein the layer of opacifying material, in the opaque state, comprises a plurality of irregular and/or odd-shaped opaque polymer particles having voids therebetween and different shapes and/or different sizes.

13. The method of claim 12, further comprising:
printing ink onto at least one void of the voids between the plurality of irregular and/or odd-shaped opaque polymer particles.

14. The method of claim 12, further comprising:
inducing the plurality of irregular and/or odd-shaped opaque polymer particles to change the opacifying material from the opaque state to the transparent state.

15. The method of claim 12, wherein the color material is covered by the opacifying material by applying a water-based emulsion over the color material.

16. The method of claim 15, wherein the water-based emulsion is a styrene acrylic emulsion.

17. The method of claim 16, further comprising:
drying the styrene acrylic emulsion to provide the opacifying material covering the color material.

18. The method of claim 12, wherein the plurality of irregular and/or odd-shaped opaque polymer particles have an average particle size of up to about 1,500 nm.

19. The reveal substrate of claim 18, wherein the average particle size is no more than about 1,000 nm.

20. The reveal substrate of claim 12, wherein the plurality of irregular and/or odd-shaped opaque polymer particles have average particle sizes between, and including, about 1,000 nm and about 1,500 nm.

* * * * *